US005560732A

United States Patent [19]

Kulp et al.

[11] Patent Number: 5,560,732

[45] Date of Patent: Oct. 1, 1996

[54] SAFETY DELINEATORS

[75] Inventors: Jack H. Kulp, San Juan Capistrano; James P. Sullivan, Orange, both of Calif.

[73] Assignee: Traffix Devices, San Clemente, Calif.

[21] Appl. No.: 195,119

[22] Filed: Feb. 10, 1994

[51] Int. Cl.[6] ..... E01F 9/00

[52] U.S. Cl. ..... 404/10; 404/13; 116/63 P

[58] Field of Search ..... 404/6, 9, 10, 13; 40/612; 116/63 P

[56] References Cited

U.S. PATENT DOCUMENTS

| | | | |
|---|---|---|---|
| D. 309,585 | 7/1990 | Kulp | D10/113 |
| 1,228,615 | 6/1917 | Stafford | 404/10 X |
| 1,939,968 | 12/1933 | Frei | 404/10 X |
| 2,103,410 | 12/1937 | Frei | 404/10 X |
| 3,451,368 | 6/1969 | Keats | 116/63 |
| 3,591,144 | 7/1971 | Iving | 404/10 X |
| 3,732,842 | 5/1973 | Vara | 404/10 X |
| 4,511,281 | 4/1985 | Schmanski | 404/10 |
| 4,973,190 | 11/1990 | Erwin et al. | 404/10 |
| 5,026,204 | 6/1991 | Kulp et al. | 404/10 |
| 5,036,791 | 8/1991 | Thurston | 116/63 C |
| 5,054,955 | 10/1991 | Habernig | 404/10 |
| 5,234,280 | 8/1993 | Cowan | 404/6 |

FOREIGN PATENT DOCUMENTS

| | | | |
|---|---|---|---|
| 2633954 | 1/1990 | France | 404/10 |
| 2122239 | 1/1984 | United Kingdom . | |

*Primary Examiner*—Roger J. Schoeppel
*Attorney, Agent, or Firm*—Donald E. Stout

[57] ABSTRACT

A safety delineator is provided having either a conical or a tubular body portion, which has an improved handle feature permitting easy and comfortable full hand gripping of the delineator. The invention additionally solves a longstanding problem common to prior art support bases for delineators and the like, by providing a convenient handle, molded integrally with the support base element, for picking up the base. The inventive handle not only provides a convenient means for grabbing the delineator, but it also provides an additional advantage with respect to conical delineators, in that it prevents them from sticking together when they are stacked. Two types of inventive support bases are disclosed. One is a base molded from a heavy solid material, such as rubber, and includes additional advantageous features such as anti-skid grippers on the bottom surface of the base element and stacking rings molded onto the upper surface of the base element for assisting in compactly stacking a plurality of bases. The second type is molded from resilient plastic, and adapted to be filled with a ballast material such as sand. This base is advantageously molded to provide a funnel structure for filling the ballast chamber, which, after the filling step is completed, is cut off. The base element edges are then sealed to permanently seal the ballast chamber. Additional features of this type of base are its dome-like configuration and the provision of corrugations on its bottom surface, both of which contribute to its crush resistance.

28 Claims, 4 Drawing Sheets

SAFETY DELINEATORS

BACKGROUND OF THE INVENTION

This application relates to traffic safety delineators, and more particularly to l improved support base element therefor, as well as to traffic safety delineators having improved gripping and stacking features.

Traffic safety delineators are extensively used at the present time to delineate potential driving hazards, such as construction zones, potholes, etc., as well as to channelize traffic past such hazards. They are often used, as well, on sidewalks, bicycle paths, parking lots, indoor shopping malls, and the like to alert passersby to potential dangers, whatever the mode of transportation.

Traffic safety delineators having a conical or tubular structure are particularly widely used, and are commonly referred to as traffic safety cones or traffic safety tubes, respectively. Although they may comprise only a freestanding conical or tubular body portion, they more typically include a separable weighted base as well, in order that the body portion may be stably supported in the wind gusts which are typically generated by high speed traffic, as well as by natural weather patterns. Prior art bases are typically fabricated of a solid material, such as rubber, in order to provide adequate weight to anchor the delineator body, which is typically molded of a resilient plastic.

Both traffic safety cones and traffic safety tubes are designed to be temporary and portable, so are frequently lifted and transported from place to place, either within a single construction site as the construction project progresses, or between different sites. Thus, it is important that the temporary markers be easy and convenient to pick up. Unfortunately, however, prior art cones and tubes typically ha no means for being conveniently gripped, and are usually just lifted by attempting to grab the conical or tubular body portion itself. With the support base attached, the delineator can be quite heavy and awkward, and thus difficult and tiresome to pick up without a proper grip. Loss of one's grip on the delineator body as it is being carried, so that the delineator is inadvertently dropped, is a recurrent problem.

Several prior art designs have been developed to attempt to provide a handle for picking up such structures. For example, a traffic safety cone having a bail handle, like that of a pail, extending from the top thereof is known in the prior art. Also, both traffic safety tubes and cones are presently available which have a T-top handle extending from the top thereof. Such a handle may be used to carry the tube or cone by grasping the T-top with one's fingers. However, neither type of handle is fully satisfactory in providing a convenient means for easily grasping and picking up a cone or tube, since they do not permit a comfortable, full hand grip, and tend to pinch and cramp the user's fingers over time.

Another problem with traffic safety cones results from the common practice of stacking the cones when storing or transporting them. Obviously, stacking the cones is advantageous because of the space which is saved and because of the increased number of cones which may be transported at one time. However, as one cone is dropped downwardly over another one in a stacking relationship, they tend to stick and jam together, because of the interfering contact between their respective sidewalls. This problem is aggravated in warm weather, when the cone sidewall material tends to expand and increase the interfering contact. Once jammed, they can be difficult to separate, and the tedious process of doing so can be labor intensive and result in downtime and frustration for the construction crew.

There are additional disadvantages with respect to the prior art weighted support bases, which are used to anchor the safety cone or tube body. Two types of bases are known. As discussed above, bases molded of solid rubber or similar resilient materials are the most prevalent, and simply comprise an octagonally shaped base element having a mounting aperture extending therethrough in order to receive and support the delineator body. This type of support base is durable, but is relatively expensive. Also, there is no provided means for lifting it to move it to a new location, other than merely to grab it with one or both hands and pick it up.

A second type of prior art weighted base is typically molded of lightweight plastic, d then ballasted, usually by filling with sand or the like. In some versions, water has been used as the ballast. Again, there is no provided means for lifting this kind of prior art base. As known in the art, such a base has a fill aperture with a resealable closure and is adapted to be filled by the end user before being placed into service. While a base of this type is considerably cheaper to manufacture than a solid material base, it is laborious to service, and typically vulnerable to damage when driven over by a vehicle. This is because it is difficult in practice to completely fill the base with ballast material, such that no voids remain in the ballast chamber. Thus, when a vehicle drives over the base element, the walls of the base element respond by caving inwardly, causing crush damage at any edge or corner and also where any void within the ballast chamber exists, because the ballast material is not present to provide rigidity and internal support to the chamber walls.

SUMMARY OF THE INVENTION

The present invention solves the aforementioned problems of the prior art by providing a safety delineator having either a conical or a tubular body portion (i.e. a traffic safety cone or a traffic safety tube), which has a new and improved handle feature permitting easy and comfortable full hand gripping of the delineator. The invention additionally solves a longstanding problem common to prior art support bases for delineators and the like, by providing a convenient handle, molded integrally with the support base element, for picking up the base. The inventive handle not only provides a ready means for grabbing the delineator, but it also has an additional advantage with respect to conical delineators, in that it prevents them from sticking and jamming together when they are stacked.

Two types of inventive support bases are disclosed. One type is a base molded from a heavy solid material, such as rubber, and includes additional advantageous features such as non-skid treads on the bottom surface of the base element and stacking rings molded onto the upper surface of the base element for assisting in compactly stacking a plurality of bases. The second type of base is molded from resilient plastic, and adapted to be filled with a ballast material such as sand. This base is advantageously molded to provide a funnel structure for filling the ballast chamber, which, after the filling step is completed, is cut off. The completely filled base element funnel structure edge is then sealed to permanently seal the ballast chamber. Additional features of this type of base are its dome-like configuration and the provision of corrugations on its bottom surface, both of which contribute to its crush resistance and shape maintenance.

More specifically, a safety delineator is provided which comprises a body portion having a top end and a base end, a horizontal support element preferably comprising a lip integral with the base end for supporting the body portion in an upstanding position, and a handle adapted to permit convenient gripping of the safety delineator. The handle extends upwardly from the body portion top and has a configuration generally resembling the handle of a baseball bat. The body portion top end has a first diameter, and the delineator handle comprises a shaft portion having a second diameter which is smaller than the first diameter. The shaft portion is axially arranged to extend upwardly from the top end. A knob portion, which is generally hemispherical, and has a third diameter which is greater than the second diameters, is located axially above the shaft portion.

Between the body portion top end and the shaft portion, a first transition region comprising a first fillet provides a generally smooth transition between the first and second diameters. Similarly, between the knob portion and the shaft portion, a second transition region comprising a second fillet provides a generally smooth transition between the second and third diameters.

The delineator body portion may be either conical or tubular. For conical delineators, another advantageous feature of the inventive handle is that the shaft portion has a length adequate to ensure that when a plurality of conical delineators are stacked, the handle of each lower delineator functions to stop the travel of the next higher stacked delineator downwardly thereupon before interfering contact between the stacked conical delineators causes the delineators to stick or jam. This feature solves a particularly longstanding and vexing problem in the art.

Another aspect of the invention is the provision of a base for supporting an upstanding structure, which comprises a base member having a substantially flat bottom surface which is adapted to be supported by a roadway or the like. A mounting aperture extends through the base member, and is adapted to receive a base end of the upstanding structure. A handle is integral with the base member for permitting convenient gripping of the support base. Preferably, the support base is adapted to be stacked compactly with other like support bases, since they are often shipped and stored in such fashion. To assist in stacking, the base member includes an upper surface which is provided with a stacking ring extending upwardly from the upper surface, as well as a stacking recess in the lower surface having a size corresponding to that of the stacking ring. Thus, when a plurality of support bases are in a stacked relationship, the stacking ring on each base element is adapted to be received by the stacking recess in the lower surface of the base member immediately thereabove.

In one type of base, the base member is molded from a resilient plastic and includes an upper surface. The upper and lower surfaces enclose a hollow chamber, which is adapted to be filled with a ballast material comprised of a flowable mass of loose particles for providing stabilization weight to the base member and for increasing its crush resistance. The base member is generally dome-shaped such that the upper surface tapers down to nearly 0 inches at the edges of the base member to substantially eliminate vertical side walls. The chamber is adapted to be permanently sealed once filled. Before being filled, as originally molded, an edge of the base member includes a funnel-like portion extending therefrom, which provides an opening into the ballast chamber and is adapted to receive ballast material for filling the chamber.

In yet another aspect of the invention, a method of fabricating a support base for an upstanding structure is disclosed. The first step is to mold a base member from a resilient plastic, which has upper and lower surfaces enclosing a hollow chamber therein and a funnel structure extending out of the base member from the chamber. Then, the chamber is filled with a ballast material comprising a flowable mass of loose particles, which is received into the chamber through the funnel structure. Preferably, the base member is shaken or spun while the chamber is being filled, in order to better settle the ballast material and thus ensure maximum packing therein without voids. Once the filling step is complete, the funnel structure is cut off such that edges of each of the upper and lower surfaces are in adjoining relationship at the cutting point. Finally, the adjoining edges are permanently sealed at the cutting point so that the ballast material is permanently sealed within the chamber.

The invention, together with additional features and advantages thereof, may best be understood by reference to the following description taken in conjunction with the accompanying illustrative drawing.

DESCRIPTION OF THE PREFERRED EMBODIMENT

Figure 1:
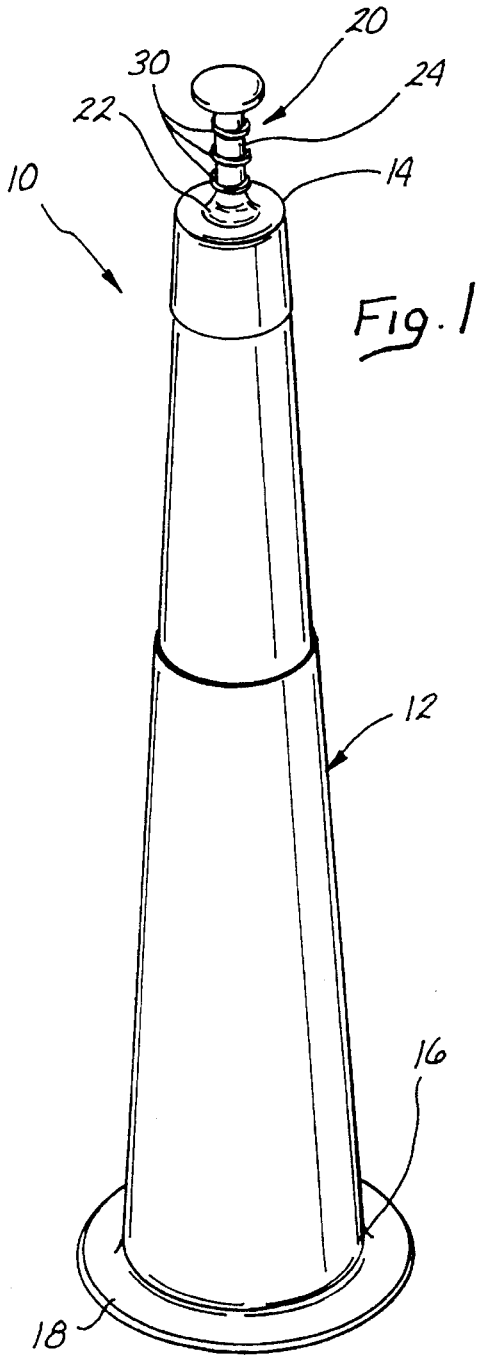
FIG. 1 is a perspective view illustrating a conical safety delineator (safety cone) constructed in accordance with the present invention.
Figure 2:
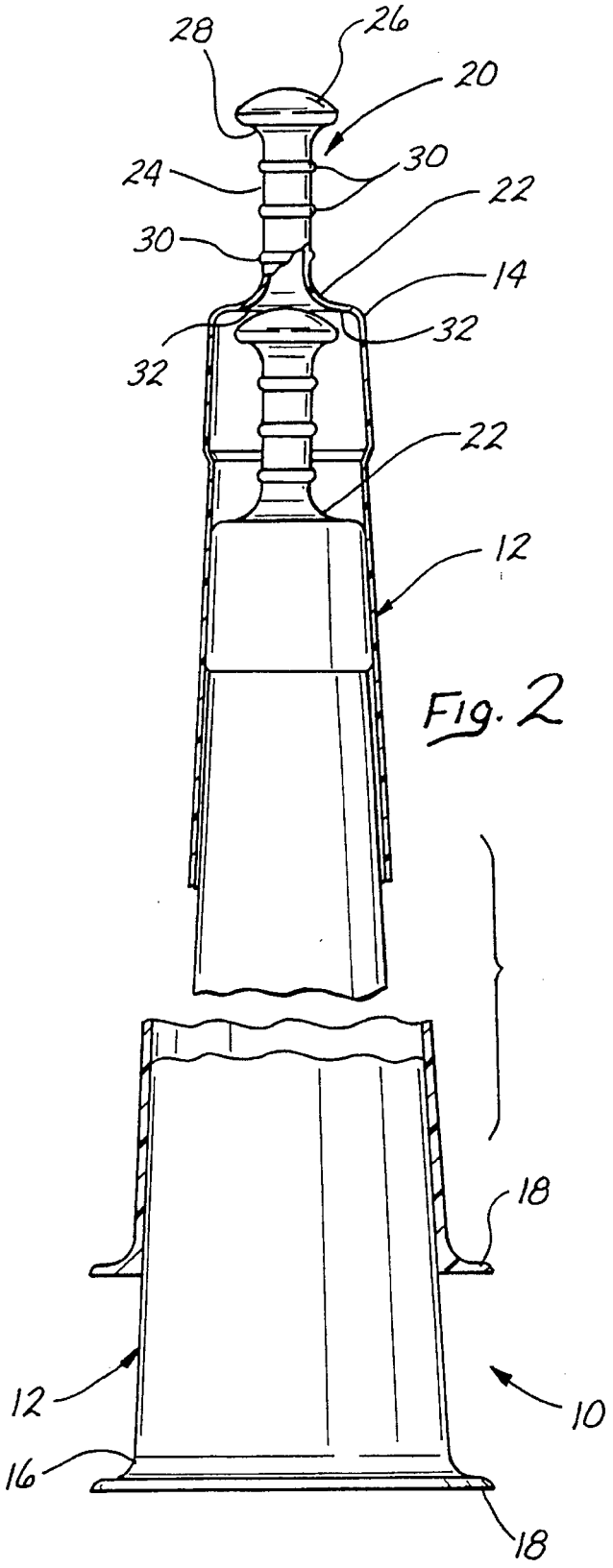
FIG. 2 is a cross-sectional view taken in elevation, illustrating two safety cones of the invention in stacking relationship.

Referring now to the drawing, FIGS. 1 and 2 illustrate a conical highway safety delineator or safety cone 10 constructed in accordance with the invention. The safety cone 10 comprises a conical body portion 12 having a top end 14 and a base end 16, wherein the conical body portion 12 has a minimum diameter at the top end 14 and expands conically to a maximum diameter at the bottom end 16. At the bottom end 16, a lip portion 18 flares outwardly to form a horizontal support base for the cone body 12, and to provide a means for assembling the cone 10 to a weighted support base (gravity anchor), as will be described hereinbelow. The cone body 12 itself, between the top end 14 and the lip portion 18, is conventional in construction and is preferably fabricated of a resilient plastic using known molding techniques.

An advantageous and important feature of the invention is the addition of a handle 20 to the cone 10, which enables a user to quickly and easily grip the cone in order to transport it between locations. The handle 20 is preferably molded to be integral with the cone body 12, extending upwardly from the top end 14, and is configured to generally resemble the handle or gripping end of a baseball bat. In its preferred configuration, the handle includes a first transition fillet 22, a necked down generally cylindrical shaft portion 24, and a generally hemispherical knob portion 26. The first fillet 22 transitions the handle 20 between the diameter of the top end 14 (approximately 4 inches in the preferred embodiment) and that of the cylindrical shaft 24. The diameter of the shaft 24 is small enough to be comfortably gripped by the hand of an average adult (approximately 1¼ inches in the preferred embodiment). A second transition fillet 28 (FIG. 2) transitions the handle 20 between the diameter of the shaft 24 and the diameter of the hemispherical knob 26, which in the preferred embodiment may be about 2¾ inches. The purpose of the knob is primarily to prevent a user's hand from slipping off of the end of the shaft 24. Of course, the actual configuration and dimensions of the handle 20 may be varied in accordance with particular design and manufacturing considerations, with the proviso that it function to permit easy and convenient gripping of the cone.

Preferably, the handle shaft portion 24 includes a plurality of spaced circumferential ribs 30 (FIGS. 1 and 2), which primarily function to improve a user's grip on the shaft by preventing slipping of his or her hand thereon. Any number of ribs may be employed, but they may also be deleted if desired, or replaced by an alternative non-skid surface, such as rubberized tape or the like.

As discussed supra in the Background of the Invention portion of the specification, safety cones of the type herein disclosed are typically stacked for compact storage and for ease of shipment between locations. However, the prior art cones generally available tend to stick and jam together when stacked, thereby making it difficult to separate them for use. This invention solves that problem because of the unique handle configuration at the top of each cone 10, which makes the cones self-spacing. Thus, when two or more cones are stacked together, as shown in FIG. 2, the top of the knob portion 26 of the lower cone abuts the interior Surface 32 of the transition portion 22 of the upper cone, thereby creating a stop which prevents further relative stacking motion between the two cones, i.e. further collapsing of the upper cone onto the lower one. Advantageously, the relative stacking motion is stopped by the abutment of the lower cone knob 26 on the upper cone interior surface 32 before the upper cone has descended onto the lower cone sufficiently to create a jamming or sticking problem.

Figure 5:
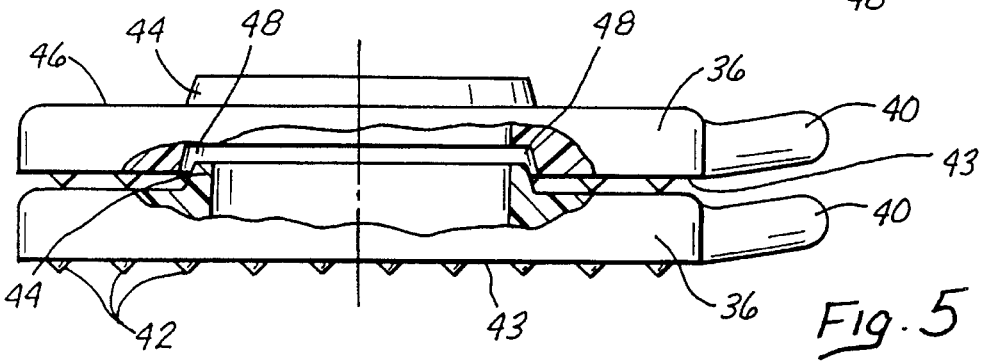
FIG. 5 is an elevational view, partially in cross-section, showing two of the bases illustrated in FIG. 3 in stacking relationship.
Figure 6:
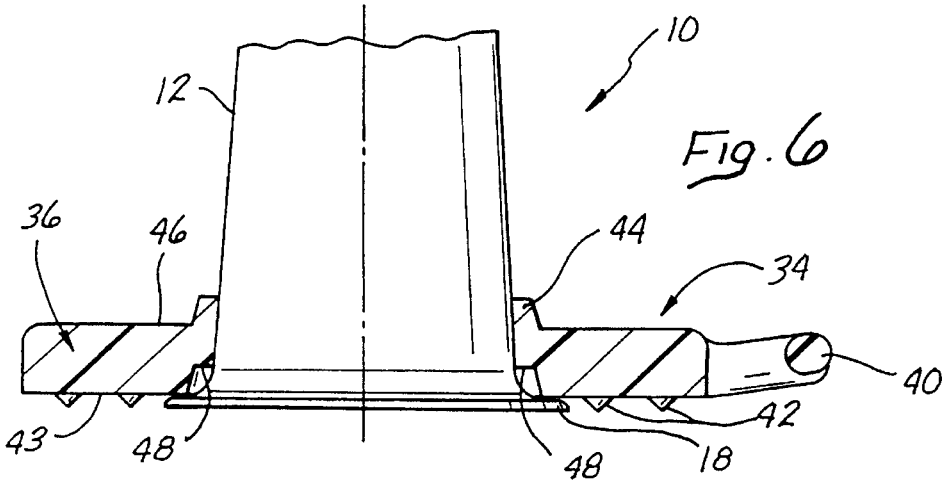
FIG. 6 is a cross-sectional view showing a cone like that illustrated in FIG. 1 assembled with a base like that illustrated in FIG. 3.

In most instances, the safety cone 10 herein described is used as a delineator or channelizer on a public street or highway, and is therefore often subject to high winds and gusts, due both to natural weather conditions and passing traffic. Consequently, although the cone body 12 may be used in a stand-alone fashion, being supported on the lip portion 18, it is usually necessary to anchor the cone 10 in a weighted stabilization or support base, such as the support base 34 shown in FIGS. 3–6. In its preferred embodiment, the support base 3 comprises a base element 36, which is fabricated of a solid material, preferably solid molded rubber or the like. An octagonal configuration is well known in the prior art, and is preferred, but the base element 36 can actually be any desired shape. An aperture 38 (FIG. 3) extends entirely through the base element 36, and functions to permit assembly or mounting of the cone 10 thereto, as shown in FIG. 6. To assemble the cone 10 and the base 34 together, the base 34 is simply slipped over the cone from the top, such that the cone body 12 extends through the mounting aperture 38, and is permitted to drop to the bottom thereof, where it comes to rest atop the lip 18 of the cone, as shown. Since the diameter of the cone lip 18 is substantially greater than that of the mounting aperture 38, tide cone 10 and the base 34 are securely assembled together until it is desired to disassemble them, by merely lifting the base 34 upwardly until it is clear of the cone body.

While basic octagonal support bases for traffic safety cones are well known in the prior art, the inventive base 34 includes several novel and advantageous features. For example, it is difficult to pick up and carry known prior art bases because of their heavy and awkward configuration and the lack of fingerholds. However, the inventive support base 34 includes a handle 40, which is molded integrally with the base element 36 and provides a convenient gripping means. An additional advantageous feature is the utilization of a plurality of anti-skid grippers 42 (FIGS. 4, 5, and 6) on the bottom surface 43 of the base element 36, for providing an anti-skid surface which helps to prevent unwanted sliding of the base. The anti-skid grippers 42 are illustrated as being generally conical protrusions, but in actuality any kind of anti-skid texturing may be employed without substantially impacting their function.

Yet another advantageous feature of the support base 34 is the employment of a stacking ring 44 on each base element 36 (FIGS. 3, 5, and 6) for the purpose of assisting the stacking of a plurality of support bases 34 in a compact, flush fashion, for easier shipment and storage. The stacking ring 44 circumscribes the mounting aperture 38, extends a predetermined height above the upper surface 46 of the base element 36, and is preferably integrally molded therewith. A corresponding stacking recess 48 is provided in the bottom surface 43, which has a diameter substantially the same as that of the stacking ring 44, and a depth substantially the same as the predetermined height of the stacking ring, so that each stacking ring may be fitted into the corresponding stacking recess of the next higher stacked base 34 for compact stacking, as illustrated in FIG. 5.

Now with reference to FIGS. 7–12, an alternative stabilization or support base embodiment 134 is illustrated, wherein like elements with respect to FIGS. 3–6 are delineated by like reference numerals, preceded by a 1. The support base 134 comprises a base element 136 having a mounting aperture 138 extending entirely therethrough (FIGS. 7 and 10) for assembling the cone 10 and the base 134, in the same manner as described above with respect to the FIG. 3 base embodiment. The base element 136 is preferably molded of resilient plastic. Additionally, a handle 140 is provided for convenient grasping and carrying of the base 134. The handle 140 is canted upwardly, as shown, for easier grasping, and preferably includes a hollow handle grip **140*a* and a solid flat extender portion 140*b* (best seen in FIG. 8), both of which are preferably also comprised of plastic and integrally molded with the base element 136. A plurality of texture elements 142 (FIG. 10) are molded into the bottom surface 143 of the base element 136 for providing an anti-skid surface, and, more importantly, for improving the structural integrity of the base element 136**, as will be described in more detail hereinbelow. A plurality of alternating ribs and grooves, i.e. a corrugated surface, is preferred. However, any type of textured surface, including ribs or grooves of any number and configuration having a greater dimension than a single layer of plastic may be employed.

Figure 3:
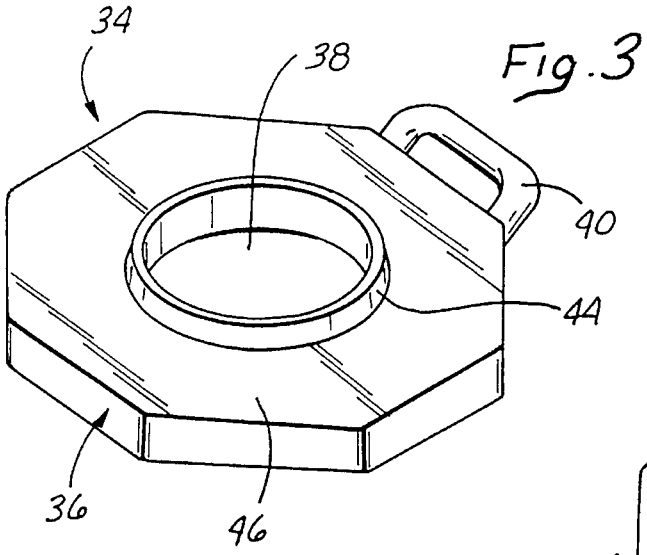
FIG. 3 is a perspective view showing a base adapted to support a safety cone or safety tube of the type disclosed herein.
Figure 4:
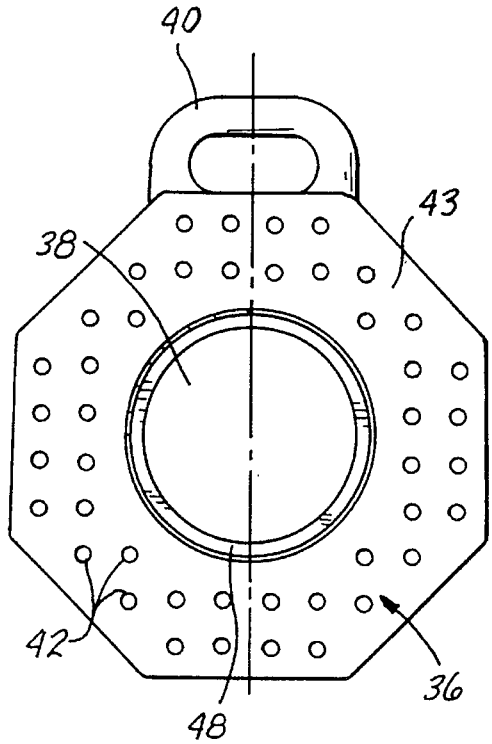
FIG. 4 is a plan view showing the bottom of the base illustrated in FIG. 3.
Figure 7:
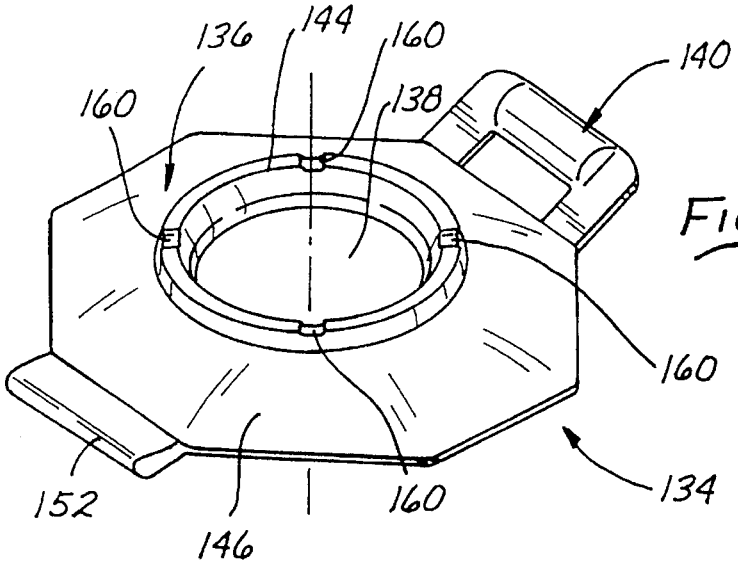
FIG. 7 is a perspective view showing an alternative embodiment of a base adapted to support a safety cone or safety tube of the type disclosed herein.
Figure 11:
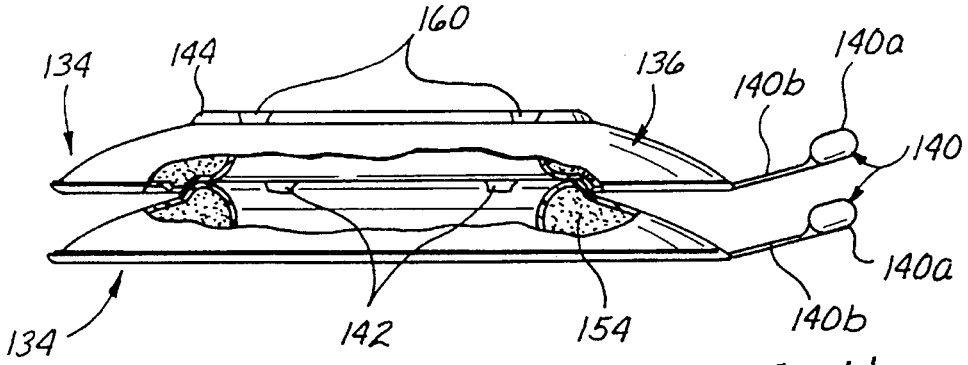
FIG. 11 is a front elevational view, partially in cross-section, showing two of the bases illustrated in FIG. 7 in stacking relationship.
Figure 12:
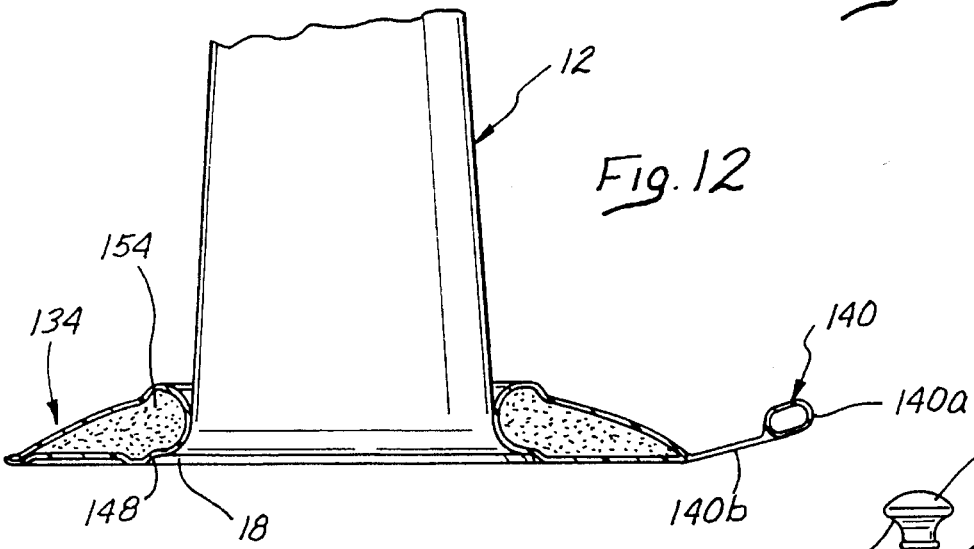
FIG. 12 is a cross-sectional view showing a cone like that illustrated in FIG. 1 assembled with a base like that illustrated in FIG. 7.

Like the FIG. 3 embodiment, the FIG. 7 embodiment also includes a stacking ring 144 which circumscribes the mounting aperture 138, extending a predetermined height above the upper surface 146 of the base element 136, and is preferably integrally molded therewith. A corresponding stacking recess 148 is provided in the bottom surface 143 of the base element 136, which has a diameter substantially the same as that of t stacking ring 144, and a depth substantially the same as the predetermined height of the stacking ring, so that each stacking ring may be fitted into the corresponding stacking recess of the next higher stacked base 134 for compact stacking, as illustrated in FIG. 11.

Figure 8:
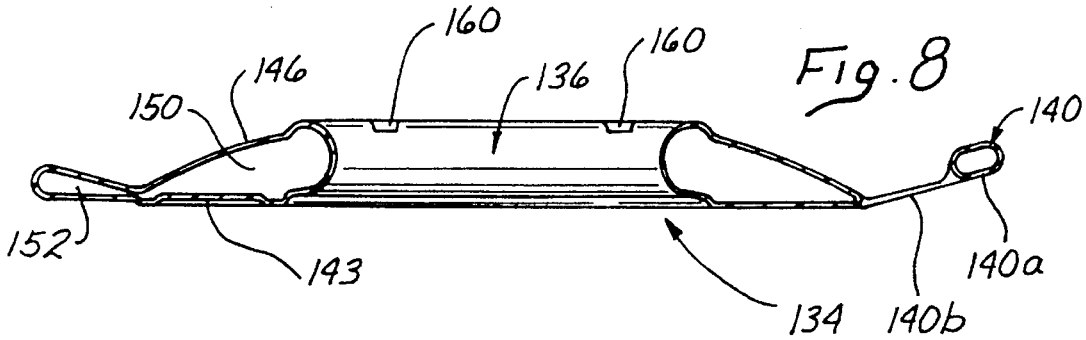
FIG. 8 is a cross-sectional view in elevation, showing the base of FIG. 7 before it has been filled with ballast during the fabrication process.
Figure 9:
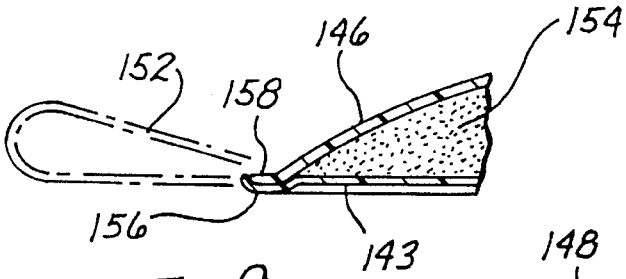
FIG. 9 is a fragmentary cross-sectional view illustrating the step of permanently sealing the base after it has been filled with ballast.
Figure 10:
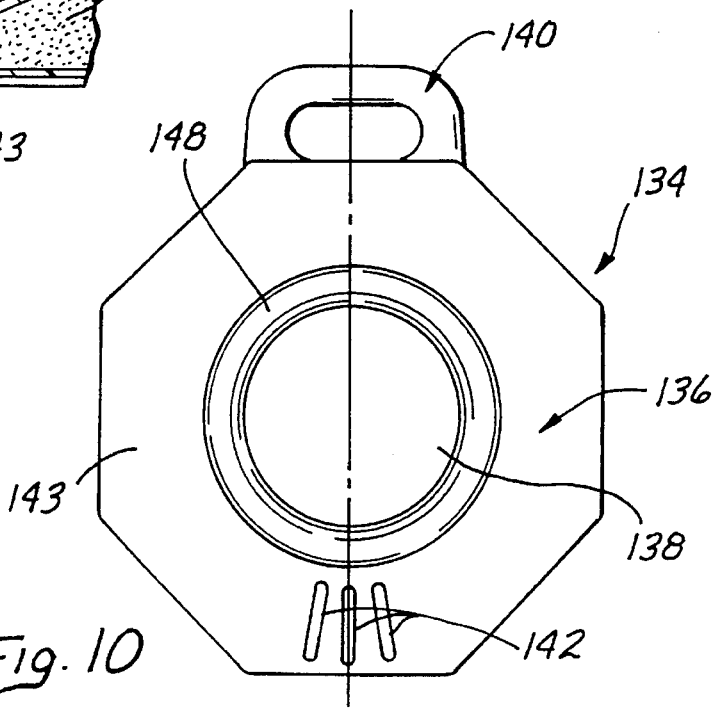
FIG. 10 is a plan view showing the bottom surface of the base illustrated in FIG. 7.

A significant difference between the base shown in FIG. 7 and that shown in FIG. 3 is that the base 134 is molded of a crush-resistant, resilient plastic, has a dome-like configuration, and is hollow. Thus, the walls of the base element 136 enclose a ballast chamber 150, as best illustrated in FIG. 8. Of course, the hollow plastic base element 136 is too light to function as an effective gravity anchor for a cone 10, so it is designed to be filled with ballast to provide adequate weight. The ballast material selected should comprise a flowable mass of loose particles which are relatively incompressible for fully occupying the ballast chamber volume, so that when the base is completely filled, it will be substantially crush-proof. The preferred ballast material is common sand, which is inexpensive and readily available. The ballast chamber 150 is sized so that, when completely filled with the selected ballast material, the base 134 will be of the desired weight for supporting the erected delineator. Referring now particularly to FIGS. 7, 8, and 9, the process for filling the base element 136 with sand or similar ballast material will be described.

Although it is within the scope of this invention to use a refillable base element 136, wherein the base element is provided with a closure which may be opened by a user, such that the element may be filled with ballast when it is to be placed in service, the preferred embodiment is permanently filled with ballast during the manufacturing process, and then permanently sealed. This approach, while requiring the shipment and storage of filled, relatively heavy support bases, is advantageous because of the reduced labor required of a construction crew to ready the delineators for service, and also because the equipment and procedures available in the fabrication facility better ensure that the base elements 136 will be completely filled with ballast material, substantially without voids. FIGS. 7 and 8 illustrate a base element 136 as originally molded, wherein the chamber 150 is empty and a funnel 152 is molded integral to a side opposite the handle 140 (the left side, as illustrated). Of course, there is no requirement that the funnel be placed opposite the handle 140 and, in fact, it could be placed along any edge. Its placement depends primarily on design factors related to the equipment which will be used to perform the sand filling process.

When it is desired to fill the base element 136, the funnel 152 is used to supply the chamber with sand 154. During the filling process, the base element 136 is vibrated or spun in order to ensure that the sand settles and completely fills every void within the chamber 150. This process is further assisted by the shape of the base element 136, which is designed to have no interrupted surfaces which would make it more difficult to ensure complete filling of the chamber. Then, once packed completely to the chamber perimeter with sand 154, the funnel 152 is cut off (FIG. 9), and the edges 156 and 158 of the lower and upper surfaces 13 and 146, respectively, are sealed together using any known sealing procedure, such as, for example, a hot iron or sonic welding procedure. Once the edges 156 and 158 have been permanently sealed, the weighted sand-filled base is ready for use.

It has been found that, when completely filled with sand, the base 134 is very resistant to damage, and thus nearly indestructible, because of the configuration of the base element 136. More specifically, rather than being polygonal, and therefore having corners and sides which may be crushed when driven over by a vehicle, the base element 136 is generally dome-shaped, having a low vertical height which prevents engagement with the undercarriage of most vehicles and which tapers down to nearly 0 inches at its edges. Additionally, the preferred alternating grooves and ridges 142 on the lower surface 143 provide structural shape to the base, thereby making it stiffer and resistant to becoming bulbous when filled with sand. The texture elements 142 are defined to engage the supporting surface for the base and thereby substantially increase the base stiffness. This increased structural rigidity and flatness provided by the corrugated bottom design prevents the base from sagging and becoming bulbous, i.e. convex after being filled with ballast. A bulbous shape for the bottom surface of the base when supported on a flat road surface would cause the base to rock back and forth, and thereby increase the possibility of damage when driven over.

When a vehicle drives over a base element 136, the ballast sand 154 is sufficiently compressible and deformable, with a lack of voids therein, such that the material selected for molding the base deforms slightly, along with the sand, in response to the weight of the vehicle to prevent destruction, leakage, or bursting of the base. It is believed that the stored sand in the base chamber 150 gives additional rigidity and internal support to the base, thereby rendering it essentially non-destructible under ordinary use. Since the sand fills up the volume of the ballast chamber 150, it remains in place and responds to any pressure applied by a motor vehicle wheel by maintaining its relationship with the inner chamber walls to prevent them from independently responding to the applied pressure.

Yet another feature employed on the inventive base 134 shown in FIG. 7 is the inclusion of a plurality of recesses 160 for guiding fiber bands which may be wrapped about a stack of the bases 134 to secure them for storage or transportation without cones 10. These recesses, of which any number may be utilized, may be molded into the base element 136, and provide yet an even more convenient means for stacking and shipping a plurality of bases.

Figure 13:
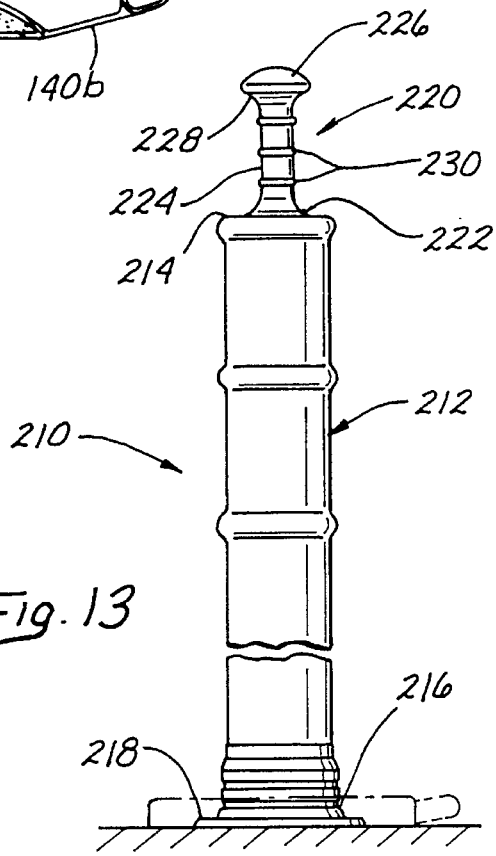
FIG. 13 is an elevational view illustrating a tubular safety delineator (safety tube) constructed in accordance with the present invention.

Referring now to FIG. 13, an alternative embodiment is shown for a tubular highway safety delineator or safety tube 210, wherein like elements with respect to FIGS. 1–12 are delineated by like reference numerals, preceded by a 2. Thus, the safety tube 210 comprises a substantially tubular body portion 212 having a top end 214 and a base end 216. At the base end 216 a lip portion flares outwardly to form a horizontal support base for the tube body 212. The tube body itself, between the top end 214 and the base end 216 is conventional in construction and is preferably fabricated of resilient plastic using known molding techniques. As is also known in the prior art, the tube body 212 may be wrapped with one or more strips of reflective tape (not shown) to increase its visibility. The tube body has a preferred diameter of about 4 inches.

As with the safety cone 10, the safety tube 210 is provided with a handle 220 which resembles that of a baseball bat, for the purpose of providing an easy and convenient means for grasping the tube comfortably. In the preferred embodiment, the construction of the handle is substantially identical to that described above with respect to the conical embodiment, including its length (about 5½ inches in the preferred embodiment) and its shaft diameter (about 1¼ inches). This is because in the preferred embodiments, the top end 14 of the cone, as well as the entire tube body 212 both have diameters of about 4 inches, and because it is desired that the handles 20, 220 both be properly scaled to the adult human hand.

Thus, in the preferred tubular delineator embodiment, the handle 220 includes a first transition fillet 222, a shaft portion 224, a knob portion 226, a second transition fillet 228, and a plurality of ribs 230, all of which have been previously described with respect to the conical delineator embodiment.

As with the cone 10, the tube 210 may be used with either a sand-filled base, as shown in FIG. 7, or a solid material base, preferably comprised of rubber or a rubberized admixture, as shown in FIG. 3. Each of the bases for the tube 210 may be identical in configuration to the bases used for the cone 10 except as to scale. Because of the tube's reduced size and mass, a smaller sized base may be used for a tube 210 relative to that which should be used for a cone 10. For example, in the preferred embodiments, the base end 216 of the tube body 212 has a diameter of about 4 inches, the same as the top end 214, whereas the base end 16 of the cone body 12 has a diameter of about 8 inches. Thus, the base for the cone body 12 requires a mounting aperture having a diameter slightly larger than 8 inches, while the base for the tube body 212 only requires a mounting aperture having a diameter slightly larger than 4 inches. Consequently, the base structure for the tube body 212, including the volumetric capacity of the ballast chamber 150 in the FIG. 7 embodiment, may be downscaled as well, while still retaining the same stability as that provided by the cone body base, because of the tube body's smaller size and concomitant reduced stabilizing weight requirements.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A method of fabricating a support base for an upstanding structure, comprising the steps of:

a) molding a base member from a resilient plastic, said base member having upper and lower surfaces which enclose a hollow chamber therein, a funnel structure extending out of said base member from said chamber;

b) filling said chamber with a ballast material comprising a flowable mass of loose particles, said ballast material being received into said chamber through said funnel structure;

c) cutting off said funnel structure such that edges of each of said upper and lower surfaces are in adjoining relationship at the cutting point; and d) permanently sealing said adjoining edges at the cutting point so that the ballast material is permanently sealed within said chamber.

2. A method of fabricating a support base, as recited in claim 1, wherein step b) includes shaking or spinning said base member while said chamber is being filled.

3. A base for supporting an upstanding structure, said support base comprising:

a base member having a bottom surface which is adapted to be supported by a horizontal surface, said base member including an integrally molded hollow chamber which is adapted to be filled with a ballast material comprised of a flowable mass of loose particles for providing stabilization weight to said base member and for increasing the crush resistance thereof, said base member having no removable cover means for permitting filling and emptying of the hollow chamber during the useful lifetime of said support base;

a mounting aperture extending through said base member which is adapted to receive a base end of said upstanding structure; and a handle integral with said base member for permitting convenient gripping of said support base.

4. A support base as recited in claim 3, wherein the bottom surface of said base member is corrugated to improve the crush resistance of said base member and to prevent skidding along said horizontal surface.

5. A support base as recited in claim 3, wherein said chamber is adapted to be permanently sealed during its useful lifetime, such that said ballast material is permanently enclosed therein.

6. A support base as recited in claim 3, wherein an edge of said base member includes a funnel-like portion extending therefrom, said funnel-like portion providing an opening into said chamber and being adapted to receive said ballast material for filling said chamber and to be permanently sealed once said ballast material has been received.

7. A support base as recited in claim 3, wherein said base member upper surface includes a plurality of guide recesses molded therein, for receiving and guiding straps which may be used to securely wrap a stack of said support bases.

8. A support base as recited in claim 3, wherein said handle is molded integrally with said base member and further comprises a hollow gripping portion spaced from said base member by a solid extender portion.

9. A safety delineator, comprising:

a body portion having a top end and a base end, said base end including a horizontal support element for supporting said body portion in an upstanding position; and a handle adapted to permit convenient generally full hand gripping of said safety delineator, said handle being integrally molded with said body portion and comprising a shaft portion axially oriented and extending axially upwardly from said body portion top end and a knob portion extending axially upwardly from said shaft portion;

wherein said handle is at least four inches long and said shaft portion therefore has a sufficient length to permit all of the fingers of an average adult hand to be wrapped thereabout in a generally full hand grip.

10. A safety delineator as recited in claim 9, wherein said handle is approximately five and one half inches long.

11. A safety delineator as recited in claim 9, wherein said body portion top end has a first diameter, said shaft portion has a second diameter which is smaller than said first diameter, and said knob portion has a third diameter which is greater than said second diameter.

12. A safety delineator as recited in claim 11, wherein said knob portion is generally hemispherical.

13. A safety delineator as recited in claim 11, and further comprising a first transition region between said body portion top end and said shaft portion and a second transition region between said knob portion and said shaft portion.

14. A safety delineator as recited in claim 13, wherein said first transition region comprises a first fillet which provides a generally smooth transition between said first and second diameters and said second transition region comprises a second fillet which provides a generally smooth transition between said second third diameters.

15. A safety delineator as recited in claim 9, wherein said body portion is conical.

16. A safety delineator as recited in claim 9, wherein said body portion is tubular.

17. A safety delineator as recited in claim 9, wherein said shaft portion has a textured outer surface, in order to provide an improved gripping surface.

18. A safety delineator as recited in claim 9, wherein said shaft portion includes a plurality of spaced circumferential ribs.

19. A safety delineator as recited in claim 9, wherein said shaft portion diameter is substantially the same at both axial ends of the shaft portion.

20. A safety delineator as recited in claim 11, wherein said second diameter is about one and one quarter inches, to thereby permit easy and convenient gripping of said shaft portion.

21. A safety delineator as recited in claim 9, wherein said body portion is conical and said shaft portion has a length adequate to ensure that when a plurality of conical delineators are axially stacked, in a nesting fashion, the handle of each lower delineator functions to stop the travel of the next higher stacked delineator downwardly thereupon before interfering contact between the conical sidewalls of the stacked delineators causes said delineators to stick or jam.

22. A safety delineator as recited in claim 9, and further including a support base comprising:

a base member having a bottom surface which is adapted to be supported by a substantially horizontal surface;

a mounting aperture extending through said base member which is adapted to receive said base end of said body portion; and a handle integral with said base member for permitting convenient gripping of said support base.

23. A safety delineator as recited in claim 22, said support base being adapted to be stacked compactly with other like support bases, wherein said base member further includes:

an upper surface;

a stacking ring extending upwardly from said upper surface; and a stacking recess in said lower surface having a size corresponding to said stacking ring;

wherein when a plurality of said support bases are in a stacked relationship, the stacking ring on each said base member is adapted to be received by the stacking recess in the lower surface of the base member immediately thereabove.

24. A safety delineator as recited in claim 22, wherein said base member is molded from a resilient plastic and includes an upper surface, said upper surface and said bottom surface enclosing a hollow chamber, said chamber being adapted to be filled with a ballast material comprised of a flowable mass of loose particles for providing stabilization weight to said base member and for increasing the crush resistance thereof, said base member further being generally dome-shaped such that said upper surface tapers down to nearly 0 inches at the edges of the base member to substantially eliminate vertical side walls, said upper surface further including a plurality of guide recesses molded therein, said lower surface including a plurality of texture elements for providing an anti-skid surface and for increasing the structural stiffness and rigidity of said base member, and said handle being canted at an upward angle and being molded integrally with said base member, said handle further comprising a hollow gripping portion spaced from said base member by a solid extender portion.

25. A safety delineator as recited in claim 24, wherein said chamber is adapted to be permanently sealed.

26. A safety delineator as recited in claim 24, wherein an edge of said base member includes a funnel-like portion extending therefrom, said funnel-like portion providing an opening into said chamber and being adapted to receive said ballast material for filling said chamber.

27. A safety delineator as recited in claim 9, wherein said handle has a configuration generally resembling the handle of a baseball bat.

28. A safety delineator as recited in claim 9, wherein said horizontal support element comprises a generally circumferential lip.

* * * * *